US005346304A

United States Patent [19]

Kleinhans

[11] Patent Number: 5,346,304

[45] Date of Patent: Sep. 13, 1994

[54] APPARATUS FOR MIXING PROPELLANT CHARGE POWDER RODS

[75] Inventor: Helmut Kleinhans, Heldenstein/Harting, Fed. Rep. of Germany

[73] Assignee: WNC-Nitrochemie GmbH, Aschau, Fed. Rep. of Germany

[21] Appl. No.: 159,747

[22] Filed: Dec. 1, 1993

Related U.S. Application Data

[63] Continuation of Ser. No. 690,947, Apr. 26, 1991, Pat. No. 5,290,100.

[30] Foreign Application Priority Data

Sep. 8, 1989 [DE] Fed. Rep. of Germany ..... 3930014
Apr. 19, 1990 [DE] Fed. Rep. of Germany ..... 4012523

[51] Int. Cl.[5] ..... B01F 13/00

[52] U.S. Cl. ..... 366/219; 241/200; 241/283; 414/746.7

[58] Field of Search ..... 414/745.8, 746.7, 756; 241/200, 283, 284; 134/124, 131; 242/67.4; 209/275; 15/94; 51/7, 17, 20; 366/2, 141, 186, 219, 237, 238, 240, 271, 332–334, 342, 345, 348, 349

[56] References Cited

U.S. PATENT DOCUMENTS

| | | | |
|---|---|---|---|
| 2,312,444 | 3/1943 | Rochford . | |
| 2,426,249 | 8/1947 | Taylor | 366/349 |
| 2,991,050 | 7/1961 | Small . | |
| 3,200,966 | 8/1965 | Peterson et al. | 414/756 |
| 3,217,899 | 11/1965 | Makowski | 414/756 |
| 3,506,142 | 4/1970 | White | 414/745.8 |
| 3,643,379 | 2/1972 | Testolin | 51/7 X |
| 3,931,896 | 1/1976 | Novis | 414/745.8 |
| 4,103,883 | 8/1978 | Shepherd | 414/756 X |
| 4,610,545 | 9/1986 | Tomlinson | 366/271 X |
| 4,678,078 | 7/1987 | Hastem-Muller | 198/690.2 X |
| 4,697,689 | 10/1987 | Carrell | 414/756 X |
| 4,758,213 | 7/1988 | Tanaka et al. | 474/265 X |

FOREIGN PATENT DOCUMENTS

| | | | |
|---|---|---|---|
| 135270 | 3/1985 | European Pat. Off. . | |
| 291532 | 4/1916 | Fed. Rep. of Germany . | |
| 169192 | 3/1906 | Fed. Rep. of Germany . | |
| 1127811 | 4/1962 | Fed. Rep. of Germany | 366/141 |
| 52342 | 6/1980 | Fed. Rep. of Germany . | |
| 2234441 | 10/1985 | Fed. Rep. of Germany | 414/746.7 |
| 2456058 | 12/1980 | France . | |
| 303600 | 2/1955 | Switzerland . | |
| 1014218 | 12/1965 | United Kingdom . | |
| 2088228 | 6/1982 | United Kingdom . | |

*Primary Examiner*—Timothy F. Simone
*Assistant Examiner*—Charles Cooley
*Attorney, Agent, or Firm*—Bell, Seltzer, Park & Gibson

[57] ABSTRACT

An apparatus for mixing propellant charge powder rods. The apparatus comprises a flexible band (1) which is suspended freely in a loop between two paraxial, radially spaced drums (2,3) and is movable back and forth between the drums (2,3) by drive motors (6,7). The band (1) is finite or endless and movable in reciprocation between two winding drums (4,5) each adapted to be driven in either direction of rotation by the drive motors (6,7). The propellant charge powder rods (30) are placed in the suspended loop of the flexible band (1)—transversely of the longitudinal direction of the band—and are mixed together by moving the band (1) back and forth. The length of the loop is increased and decreased periodically during this process.

11 Claims, 3 Drawing Sheets

APPARATUS FOR MIXING PROPELLANT CHARGE POWDER RODS

CROSS REFERENCE TO RELATED APPLICATIONS

This is a continuation of copending application Ser. No. 07/690,947 filed Apr. 26, 1991, U.S. Pat. No. 5,290,100.

BACKGROUND OF THE INVENTION

The invention relates to an apparatus for mixing and a method of mixing propellant charge powder rods.

It is conventional to produce propellant charge powders in individual batches. To a certain extent the properties of the propellant charge powder vary from batch to batch because the manufacturing conditions prevailing during production of a batch are not precisely reproducible for another batch. Therefore, different batches of any one type of powder are mixed together in order to minimize the spread of the propellant charge powder characteristics around a given medium value, thus obtaining uniform quality in the long run.

Where the propellant charge powder is available in the form of sticks or rods, the mixing so far is carried out manually, with strict observance of mixing rules, for example by exchanging certain proportions of batches of propellant charge powder rods positioned side by side on a mixing table. Although attempts have been made in the past to mechanize the mixing process by the use of mixing drums, they did not meet with success since the propellant charge powder rods assumed oblique positions in the mixing drum, becoming jammed with one another, and impeding the further movement of the rods so that mixing no longer took place. Another disadvantage of the mixing drum method became evident in emptying the mixing drums: Prior to being able to pass on the unaligned, crisscross heap of rods to further steps in the production, they had to be fed to a vibrating or sorting device for proper alignment.

It is the object of the instant invention to indicate an apparatus and a method by which to mix propellant charge powder rods mechanically.

SUMMARY OF THE INVENTION

This object is met, in accordance with the invention, by an apparatus for mixing propellant charge powder rods, comprising a flexible band which is suspended freely in a loop between two paraxial, radially spaced drums and movable back and forth between the drums by drive means.

The object further is met by a method of mixing propellant charge powder rods, wherein the propellant charge powder rods are placed in the upwardly open, freely suspended loop of a flexible band, in parallel with the plane thereof, and thereupon the band in the loop is moved back and forth at least once.

The expressions "propellant charge powder rods" or "powder rods" in the sense of the instant invention are to be understood as comprising also propellant charge powders or powders which differ from the usual cross sectional shape of a "rod or stick" in that their cross section is perforated, tubular, polygonal or in any other way different.

The invention provides for positioning the propellant charge powder rods with their longitudinal extension transversely of the direction of movement of the flexible band in the suspended loop of the band and mixing them by moving the band back and forth between the (loop). drums. That makes the propellant charge powder rods roll above and below one another, while maintaining their lengthwise alignment, and intensive mixing takes place.

The solution proposed by the invention eliminates the cumbersome mixing by hand so that a reduction in production cost can be achieved. Moreover, the mixing of propellant charge powder rods of different batches is very good and uniform. On the whole, the apparatus and method according to the invention are suited to simulate the course of the conventional manual mixing which follows precise specifications with the advantages of mechanization (e.g. reliability, lower costs). Adaptation to the various specifications for mixing can be obtained, for instance, by connecting in series several apparatus according to the invention or by carrying out the method according to the invention in a plurality of successive courses following different mixing specifications.

Another advantage of the apparatus and method according to the invention is to be seen in the fact that the specific safety requirements involved in the handling of propellant charge powders are fulfilled to a high degree by the mechanical realization of the mixing process.

Advantageous further developments of the apparatus and method according to the invention are described below.

For instance, two alternatives are suggested in examplary fashion for the design of the flexible band. With the first one, the band is endlessly closed band and, outside of the loop, it passes around at least one drive drum adapted to be driven in either direction of rotation. In the case of the other alternative, the flexible band is finite and runs back and forth between two winding drums, each adapted to be driven in either direction of rotation. In both cases preferably the loop drums are designed as deflecting drums.

Regarding the second alternative of the flexible band, it is advantageously provided in connection with the deflection drums that the band runs directly from each deflecting drum to one each of the two winding drums.

A further development according to which the length of the flexible band is variable in the loop between the two loop drums or deflecting drums is particularly advantageous for the mixing process. This makes the bending line of the loop of the band variable and, as a consequence, especially the propellant charge powder rods roll over above and below one another still more intensively.

An extension of the loop beyond a certain size or full tightening of the flexible band during the mixing operation both are avoided by furnishing the apparatus with switching mechanisms detecting the greatest extension of the loop, for example, by a sensor positioned below the band at the periphery thereof. An examplary sensor may be a capacitive sensor. Two further inductive sensors cooperating with copper strips at the band ends effect the changeover for moving the band back and forth periodically.

Again two alternatives are proposed, by way of example, for varying the length of the flexible band in the loop. According to the first one, at least one compensating roller is associated with the band outside of the loop and can be adjusted radially to change the length of the loop. The second alternative advantageously provides for the length of the loop to be varied by driving the two winding drums at different circumferential speeds. In principle, different directions of rotation of the winding drums would be conceivable as well.

Advantageously, a control means may be provided to change the loop length periodically between minimum and maximum values during the back and forth movement of the band as that will lead to further improvement of the result obtained by the mixing.

Preferably, at least one of the two loop drums is adjustable in height, whereby at least one of the points of deflection can be raised or lowered. One-sided raising of one of the loop drums and/or simultaneous lowering of the other loop drum, if desired, makes it possible to tighten the flexible band so that it will present an inclined plane for automatic emptying of the apparatus. The adjustable gradient of the inclined plane will then permit the mixed propellant charge powder rods to be loaded gently into ready containers or onto conveyor belts moving them on or into further mixing apparatus. Automatic loading of the apparatus with powder rods is possible by means of this further development of the invention: Adjustment of a correspondingly slight sagging of the band in its inclined plane position by making the band longer between the loop drums permits the powder rods to be rolled gently into the depression thus formed. For mixing, the band length between the loop drums is increased still further so that a sagging loop is obtained once more.

The flexible belt with an antistatic finish may be a commercially available conveyor belt. Furthermore, it may be provided at the side facing the interior of the loop with transverse studs, preferably of triangular cross section, to further enhance the thorough mixing of the propellant charge powder rods.

Especially preferred is the provision of a limiting wall at either of the open ends of the loop formed by the band, these limiting walls extending transversely of the plane of the band and at a spacing from each other which is a little greater than the length of the propellant charge powder rods. These limiting walls advantageously serve to prevent the propellant charge powder rods from falling off while being mixed.

Advantageously, the spacing between the two limiting walls is adjustable for adaptation to the length of the powder rods and, if desired, the band is replaceable by a wider or a narrower one as this will permit the mixing of powder rods of any desired length.

Advantageous further developments of the method according to the invention essentially relate to various measures of influencing the reciprocating movement of the flexible band.

For example, it is advantageous to vary the length of the band in the loop periodically between minimum and maximum values during the back and forth movement. Preferably, the minimum value of the length of the band in the loop is between 40 and 50% of the maximum value of the length of the band.

Further indications relate to preferred values of the speed of the band, which is stated as corresponding to an average value of some 3 meters per minute, the duration of the period of one back and forth movement of the band, stated as being between 2 and 30 minutes, and the duration of the period of one loop change, stated as being a value between 10 and 150 seconds.

For further mechanization of the process, preferably it is provided that the weight of the propellant charge powder rods introduced is determined during the loading of the apparatus, and the loading operation is stopped automatically in response to a comparison to be made of the weight determined with the desired weight of a load and the mixing operation is started when the desired weight of the loading has been reached.

BRIEF DESCRIPTION OF THE DRAWINGS

The invention will be described further, by way of a preferred embodiment, with reference to a drawing, in which.

DETAILED DESCRIPTION OF THE PREFERRED EMBODIMENTS

Figure 1:
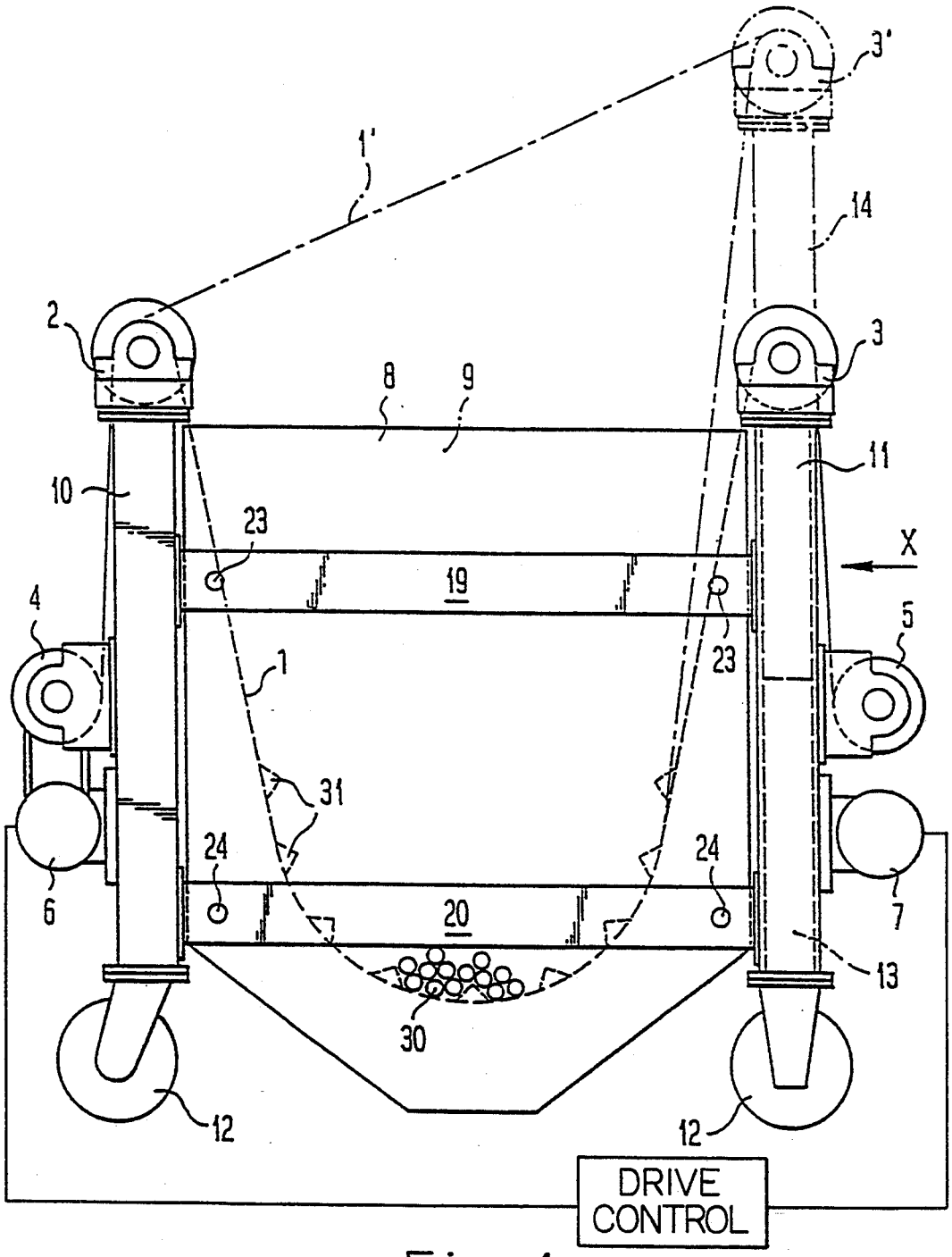
FIG. 1 is a side elevation of the apparatus with a finite band.
Figure 2:
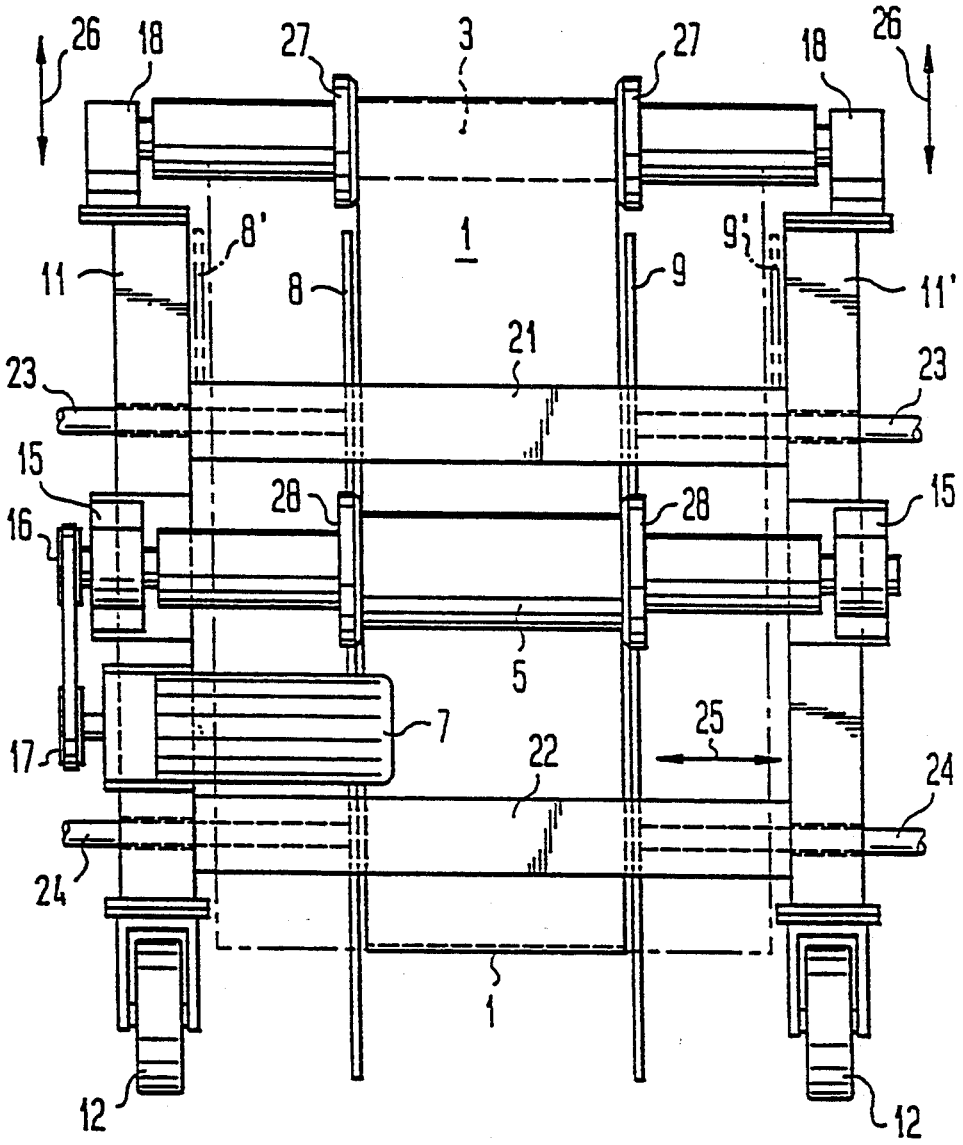
FIG. 2 is a front elevation of the apparatus, looking in the direction of X in FIG. 1.

FIG. 1 shows an apparatus for mixing propellant charge powder rods 30 including a box-like machine frame which is adapted to roll. The machine frame comprises four vertical beams of which only the vertical beams 10, 11 are to be seen in this presentation. The vertical beams 10, 11 as well as the other two vertical beams behind them in the plane of the drawing are interconnected by respective lower and upper longitudinal. beams 19,20. Between these longitudinal beams 19,20 two transverse beams 21,22 each are received in pairs with the aid of upper guide bars 23 and lower guide bars 24 (FIG. 2). For easier movement of the machine frame, the vertical beams are provided at the bottom with rolls 12.

The vertical beams 10,11 and the vertical beams behind them support the loop drums 2,3 designed as deflecting drums for the flexible band 1 which is suspended in a loop between the deflecting drums 2,3. In this embodiment the flexible band 1 is embodied by a finite band which passes around each deflecting drum 2,3 directly to a winding drum 4,5 each arranged at the transverse sides of the machine frame. The winding drums 4,5 are adapted to be driven—preferably at different circumferential speeds—by drive means 6,7 likewise arranged at the transverse side of the machine frame. The drive means 6,7 are embodied by frequency-controlled, explosion-proof motors of conventional type having a high step-up ratio which are connected to the winding drums 4,5 by a belt drive. As an alternative of the belt drive a chain drive may be used. The flexible band 1 runs from its one end wound around the winding drum 4 over the deflecting or loop drum 2 and, forming a bending line and being supported on the upper transverse beams 21, over the other deflecting or loop drum 3 to the second. winding drum 5. If the winding drums 4,5 are driven at different circumferential speeds the flexible band 1 becomes longer or shorter and the periphery of the bending line of the flexible band 1 moves in vertical direction between a maximum value and a minimum value. It depends on the filling of the flexible band 1 and on the length thereof whether or not it is supported on the lower transverse beams 22 (FIG. 2). The flexible band 1 may be provided on its side facing the interior of the loop with transverse studs 31 which promote the mixing of the powder rods 30 introduced.

At the two open sides of the loop of the band 1 there is a limiting wall 8,9 each extending transversely of the plane of the band 1 and being displaceable in transverse direction on the upper and lower guide bars 23,24, respectively (FIG. 2). Hereby their lateral spacing is variable to adapt it to different lengths of the propellant charge powder rods 30. At the bottom end, the lateral limiting walls 8,9 essentially have a shape which is adapted to the suspended loop of the flexible band 1.

In the embodiment shown in FIG. 1, the deflecting or loop drum 3 is designed to be movable in vertical direction by a drive means housed, for instance, in the vertical beam 11 and consisting, for instance, of an hydraulic piston and cylinder arrangement 13,14. The vertical adjustability of the deflecting drum 3 makes it possible to tighten the flexible band 1 so as to present an inclined plane for discharge purposes, as may be seen in FIG. 1 by the discontinuous presentation of the deflecting drum 3' and of the band 1'. In this presentation of the band 1' in discontinuous lines, the propellant charge powder rods 30 may roll sideways off the band 1' into ready containers or onto conveyor belts which lead them on.

FIG. 2 shows the apparatus looking in X direction of FIG. 1. The two neighboring vertical beams 11,11' support the bearings 18 for the deflecting drum 3 which is movable vertically in the direction of arrow 26 by a drive means described in exemplary fashion above. Below the deflecting drum 3, in the presentation, yet not in the same vertical plane, there is the upper transverse beam 21 which is connected to the longitudinal beam 19 by the upper guide bar 23 (FIG. 1). The bearings 15 for the winding drum which takes up one end of the flexible band 1 are fastened to the vertical beams 11,11'. At its driven end, the winding drum 5 possesses a pulley 16 which is operatively connected by a belt to a pulley 17 underneath belonging to the drive means 7 which is fastened to the vertical beam 11.

The lateral limiting walls 8,9 can be shifted axially in the direction of arrow 25 on the upper and lower guide bars 23,24, respectively, into the positions shown in discontinuous lines and marked by reference numerals 8', 9' so as to adapt them to propellant charge powder rods of different lengths. The radial flanges 27,28 at the deflecting drums 2,3 and at the winding drums 4,5, respectively, also are movable axially, likewise in the direction of arrow 25, in order to permit the use of a flexible band 1 of greater width as well. The two drive means 6,7 are connected to a control means as schematically illustrated in FIG. 1 for periodically changing the length of the loop between minimum and maximum values, while the band moves back and forth.

The method according to the invention of mixing propellant charge powder rods will be described with reference to the apparatus specified above and preferably takes place as follows:

First of all, the powder rods 30 are placed in the upwardly open, freely suspended loop of the flexible band 1 in such manner that the longitudinal extension of the powder rods 30 is transversely of the direction of movement of the band 1 in the loop. During the loading operation the weight of the powder rods 30 added is determined by a suitable device, not explained in detail here, and the loading operation is stopped as the desired weight of a batch is being reached.

During the mixing process which begins subsequently the flexible band 1 carries out motion which is composed of two basic movements being superimposed over each other. The first basic movement of the band 1 is produced by the winding drums 4,5 rotating at the same winding speed and one of them taking up the band 1, while the other one pays off the band 1. During this basic movement the band 1 runs at constant band velocity between the two deflecting drums 2,3, maintaining its loop configuration. The direction of movement of the band 1 is reversed automatically when the end of the band on the winding drum which pays off has been reached.

The second basic movement of the flexible band 1 consists in both winding drums 4,5 either winding or unwinding, whereupon the band length between the two deflecting drums becomes shorter or longer, respectively, and the loop carries out movement in vertical direction while changing its bending line. During this basic movement, too, suitable means for measuring and reversal make sure that the band 1 is neither tightened completely nor touches the ground.

The resultant motion which is utilized in the mixing operation is obtained by one of the winding drums 4,5 winding up the band 1, while the other one unwinds it, with the two winding drums 4,5 rotating at different winding speeds. As a result, the band 1 moves according to the first basic movement and, at the same time, the loop becomes shorter or longer by virtue of the different winding speeds of the winding drums 4,5, i.e. it moves in vertical direction. The second basic movement is realized in that the winding drums 4,5 effect winding or unwinding of the band 1, based on their different winding speeds. During this operation, the duration of the period of shortening or lengthening of the loop—according to the second basic movement—is shorter than the reciprocating movement of the band 1 in the loop in accordance with the first basic movement. At an average band velocity of 3 m/min. the duration of the period for shortening or lengthening the loop is 30 seconds, the period duration for back and forth movement of the band 1 is 3 minutes, and the overall time of treatment provided for one batch is 15 minutes.

Figure 3:
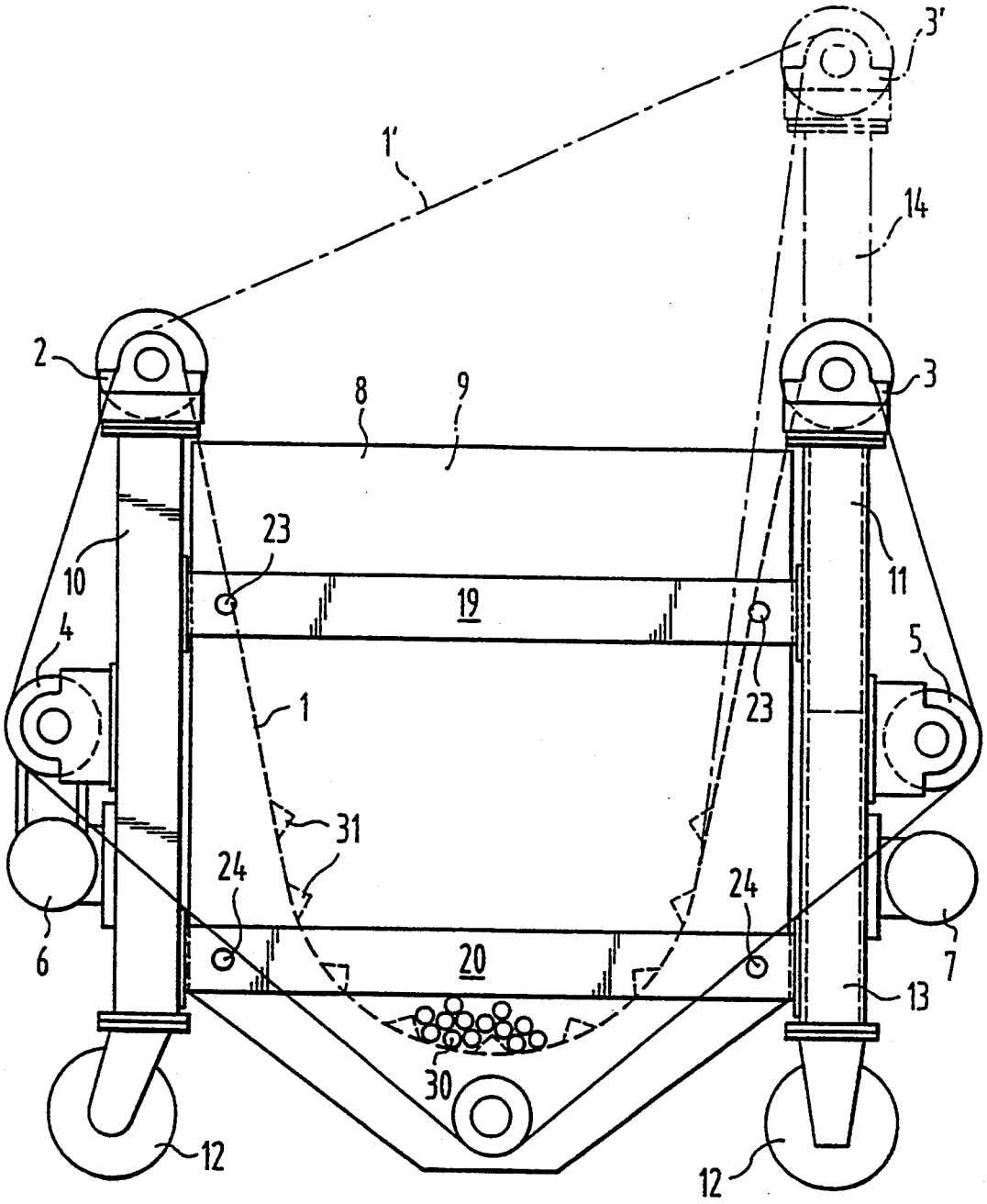
FIG. 3 is a view similar to FIG. 1, but illustrating a further embodiment of the present invention with an endless band.

FIG. 3 illustrates an embodiment of the present invention wherein the band 1 is endless, and the means for driving the belt comprises drive drums 4, 5 which are each positioned so as to engage the band at a location outside of the loop. As in the first embodiment, the drums 4, 5 of FIG. 3 are adapted to be driven in either direction of rotation by a suitable control.

In the drawings and specification, preferred embodiments of the invention have been disclosed, and although specific terms are employed, they are used in a generic sense only and not for purposes of limitation.

What is claimed is:

1. An apparatus for mixing propellant powder rods comprising:

a support frame, a pair of deflecting drums mounted to said support frame, with said deflecting drums being disposed along parallel axes and being laterally spaced from each other, a flexible band supportingly draped between said deflecting drums and so that the flexible band is suspended freely and forms a downwardly hanging unsupported loop therebetween, a plurality of transverse studs mounted on the side of said band facing the interior of said loop, lateral limiting means mounted to said support frame on each side of the portion of said band extending between said deflecting drums, and drive means for moving said band back and forth between said deflecting drums, whereby said band and said limiting means are adapted to support the powder rods so that the powder rods are supported upon the loop of said band and with their longitudinal length being transverse to the direction of movement of said band between said deflecting drums and whereby said transverse studs engage the powder rods and enhance the mixing thereof.

2. The apparatus as claimed in claim 1, wherein said band is endless, and said drive means comprises a drive drum mounted on said support frame so as to engage said band outside of the band loop, and with said drive drum being adapted to be driven in either direction of rotation.

3. The apparatus as claimed in claim 1, wherein said band is of finite length, and said drive means comprises a pair of drive drums mounted to said support frame for engaging opposite end portions of said band, with said pair of drive drums each being adapted for rotation in opposite directions.

4. The apparatus as claimed in claim 3, wherein said drive drums are positioned such that said band extends directly from each of said deflecting drums to respective ones of said pair of drive drums.

5. The apparatus as claimed in claim 4, further comprising control means for operating said pair of drive drums at different speeds so as to vary the length of the loop.

6. The apparatus as claimed in claim 5, wherein said control means is adapted to change the loop length periodically between minimum and maximum values while the band is moving back and forth.

7. The apparatus as claimed in claim 1, further comprising means for adjusting the length of the loop.

8. The apparatus as claimed in claim 1, further comprising means mounting at least one of said pair of deflecting drums so that it is adjustable in height.

9. The apparatus as claimed in claim 1, wherein said transverse studs are spaced apart from each other in the direction of movement of said band between said deflecting drums.

10. The apparatus as claimed in claim 9, wherein said transverse studs are triangular in cross section. —

11. The apparatus as claimed in claim 1, wherein said lateral limiting means are in the form of generally planar walls, and wherein said apparatus further comprises means mounting said walls to said support frame so as to permit the spacing therebetween to be adjusted and thereby be adopted to different lengths of propellant charge powder rods.

* * * * *

UNITED STATES PATENT AND TRADEMARK OFFICE

CERTIFICATE OF CORRECTION

PATENT NO. : 5,346,304

DATED : September 13, 1994

INVENTOR(S) : Helmut Kleinhans

It is certified that error appears in the above-indentified patent and that said Letters Patent is hereby corrected as shown below:

Column 2, line 1, after "(loop)" omit the period (.).

Column 4, line 12, omit "and".

Column 4, line 29, before "beams" omit the period (.) (first occurrence).

Signed and Sealed this

Twenty-seventh Day of December, 1994

*Attest:*

Bruce Lehman

BRUCE LEHMAN

*Attesting Officer*

*Commissioner of Patents and Trademarks*